US007783229B2

(12) United States Patent
Noh

(10) Patent No.: US 7,783,229 B2
(45) Date of Patent: Aug. 24, 2010

(54) DETACHABLE DEVELOPER HAVING DEVELOPMENT UNIT SUPPORTED AT THREE POSITIONS

(75) Inventor: Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 229 days.

(21) Appl. No.: 12/007,692

(22) Filed: Jan. 14, 2008

(65) Prior Publication Data

US 2008/0212995 A1 Sep. 4, 2008

Related U.S. Application Data

(63) Continuation of application No. 11/049,288, filed on Feb. 3, 2005, now Pat. No. 7,406,275.

(30) Foreign Application Priority Data

Feb. 3, 2004 (KR) ..... 10-2004-0006973

(51) Int. Cl.
*G03G 15/08* (2006.01)

(52) U.S. Cl. ..... 399/119

(58) Field of Classification Search ..... 399/113, 399/119, 258

See application file for complete search history.

(56) References Cited

U.S. PATENT DOCUMENTS

| | | | | |
|---|---|---|---|---|
| 4,757,344 A | | 7/1988 | Idenawa et al. | |
| 4,814,816 A | * | 3/1989 | Idenawa | 399/234 |
| 4,866,482 A | | 9/1989 | Hirasawa et al. | |
| 5,089,849 A | * | 2/1992 | Hiraoka | 399/119 |
| 5,471,286 A | * | 11/1995 | Tanaka | 399/167 |
| 6,246,841 B1 | | 6/2001 | Merrifield et al. | |
| 6,377,765 B1 | | 4/2002 | Shishido et al. | |
| 6,580,888 B2 | | 6/2003 | Horrall et al. | |

(Continued)

FOREIGN PATENT DOCUMENTS

JP 06167869 6/1994

(Continued)

OTHER PUBLICATIONS

Supplemental Notice of Allowability dated May 12, 2008 for related U.S. Appl. No. 11/049,288.

(Continued)

*Primary Examiner*—Quana M Grainger
(74) *Attorney, Agent, or Firm*—Staas & Halsey LLP

(57) ABSTRACT

A detachable developer in which a photosensitive unit and a development unit are separately and independently installed in a main body. The detachable developer includes a first axis connection member extending from one end portion of the photosensitive unit toward a rotation axis of a developing roller and having a first guide slot formed therein in which one end portion of the rotation axis of the developing roller is inserted, and a second axis connection member extending from the other end portion of the development unit toward a rotation axis at the other end portion of a photosensitive drum and having a second guide slot formed therein in which the other end portion of the rotation axis of the photosensitive drum is inserted. The first axis connection member and the second axis connection member extend parallel to each other.

5 Claims, 4 Drawing Sheets

U.S. PATENT DOCUMENTS

| | | | | |
|---|---|---|---|---|
| 2002/0071693 | A1 | 6/2002 | Shimaoka | |
| 2002/0181969 | A1 | 12/2002 | Terada et al. | |
| 2003/0002883 | A1 | 1/2003 | Sato et al. | |
| 2003/0219284 | A1* | 11/2003 | Ishiguro et al. | 399/258 |
| 2004/0096240 | A1 | 5/2004 | Kim | |
| 2005/0207769 | A1 | 9/2005 | Matsuda | |
| 2006/0245784 | A1* | 11/2006 | Tsuzuki et al. | 399/111 |
| 2006/0245785 | A1* | 11/2006 | Kawamura et al. | 399/111 |

FOREIGN PATENT DOCUMENTS

| | | |
|---|---|---|
| JP | 09062099 | 3/1997 |
| JP | 2000-75769 | 3/2000 |
| KR | 1998-45824 | 9/1998 |
| KR | 2001-39690 | 5/2001 |
| KR | 2002-72245 | 9/2002 |

OTHER PUBLICATIONS

Notice of Allowance dated Mar. 21, 2008 for related U.S. Appl. No. 11/049,288.

Office Action mailed Jul. 13, 2007 for related U.S. Appl. No. 11/049,288.

Office Action mailed Jan. 17, 2007 for related U.S. Appl. No. 11/049,288.

Office Action mailed Jul. 28, 2006 for related U.S. Appl. No. 11/049,288.

Office Action mailed Feb. 3, 2006 for related U.S. Appl. No. 11/049,288.

Chinese Office Action for corresponding Chinese Patent Application No.:2005100541840 dated Dec. 7, 2007, 5 pgs.

* cited by examiner

DETACHABLE DEVELOPER HAVING DEVELOPMENT UNIT SUPPORTED AT THREE POSITIONS

CROSS-REFERENCE TO RELATED APPLICATION

This application is a Continuation of application Ser. No. 11/049,288, filed Feb. 3, 2005 now U.S. Pat. No. 7,406,275, which is herein incorporated by reference. This application claims the priority of Korean Patent Application No. 2004-6973, filed on Feb. 3, 2004, in the Korean Intellectual Property Office, the disclosure of which is incorporated herein in its entirety by reference.

BACKGROUND OF THE INVENTION

1. Field of the Invention

The present invention relates to a detachable developer used for a laser printer or a photocopier, and more particularly, to a detachable developer which can maintain a uniform development nip even when a photosensitive unit and a development unit are independently installed.

2. Description of the Related Art

A developer used for a laser printer, a photocopier, or a multifunctional printer is provided in the form of a cartridge to print a processed image on paper. Conventionally, a photosensitive unit and a development unit are installed together in a single cartridge. A latent electrostatic image is formed on the photosensitive unit by being exposed to a laser. The development unit forms a toner image corresponding to the latent image by supplying toner to the photosensitive unit. However, since the life span of the photosensitive unit is much longer than that of the development unit, if the life span of the development unit ends, the photosensitive unit is replaced together with the development unit, even though the photosensitive unit does not need replacement.

To solve the above problem, as shown in FIG. 1, a structure to separately drive a photosensitive unit 100 and a development unit 200 has been suggested. According to this structure, the photosensitive unit 100 and the development unit 200 are independently installed on a main body of a printer or a photocopier and a driving force from the main body is independently transferred. Referring to FIG. 1, the structure of each of the photosensitive unit 100 and the development unit 200 is described.

The photosensitive unit 100 includes a photosensitive drum 120 and a charge roller 140 which are assembled at their respective positions in a photosensitive unit housing 110. The photosensitive drum 120 is partially exposed from the photosensitive unit housing 110. A photosensitive unit coupling member 130 to transfer the driving force from the main body to the photosensitive unit 100 is coupled to an end portion of a rotation axis of the photosensitive drum 120. The photosensitive unit housing 110 is fixed in a main body frame (not shown) such as a printer.

The development unit 200 includes a developing roller 210 to provide the photosensitive drum 120 with toner, a toner supply roller 220 to supply the toner to the developing roller 210, a development unit coupling member 250 to transfer a driving force from the main body to the development unit 200, a gear train 240 having a plurality of gears to transfer the driving force of the development unit coupling member 250 to the developing roller 210 and the toner supply roller 220, and a development unit housing 230 to which the above parts are fixed. The developing roller 210 is partially exposed outside the development unit housing 230 to contact the photosensitive drum 120. When the development unit 200 is installed at the main body, the development unit coupling member 250 is connected to a driving apparatus connecting unit (not shown) of the main body.

Typically, in the conventional detachable type developer having the above structure, the photosensitive unit 100 is fixed to the main body. To form an image, the developing roller 210 and the photosensitive drum 120 contact each other while maintaining a particular contact width, that is, nip, and a nip depth. The development unit 200 is pressed against the photosensitive unit 100 by a force of a spring (not shown) when the development unit 200 is installed at the main body. The development unit coupling member 250 is connected to a driving apparatus connection unit (not shown). During the transfer of the driving force, the entire development unit 200 can swing around an axis. That is, one end portion of the development unit coupling member 250 is connected to the driving apparatus connection unit (not shown) fixed in the main body and the other end portion thereof is fixed to the main body frame. Thus, the development unit coupling member 250 becomes a rotation axis of the swing motion and the overall development unit 200 swings around the development unit coupling member 250 so that the development nip is maintained.

In general, in an image forming apparatus using a non-magnetic contact type developing method in which the developing roller 210 and the photosensitive drum 120 are engaged and rotate in contact with each other, the most important requirement for image quality is to maintain a uniform development nip between the developing roller 210 and the photosensitive drum 120. Typically, the nip depth is between 0.05-0.15 mm. If the nip depth is outside the above range, image dirt and toner stress becomes severe due to an excessive nip. In contrast, when the nip is not formed, an image cannot be formed.

Both end portions of the development unit coupling member 250 which serve as the rotation axis of the development unit 200 performing a swing motion are fixed to the driving apparatus connection unit and the main body frame. Accordingly, once the development unit 200 is installed at the main body, the position thereof is permanently fixed. Therefore, an axis arrangement can deviate due to an error generated during assembling and manufacturing processes and also due to a torque generated during transfer of power. In particular, since the length in the axis direction increases in the case of using paper having a size greater than A4, it is more difficult to align the axis stably. FIG. 2 shows a case in which the positions of the axis are incorrect at both end portions of the development unit coupling member 250. Referring to FIG. 2, the developing roller 210 and the photosensitive drum 120 contact each other by being deviated from each other. When the developing roller 210 and the photosensitive drum 120 are deviated from each other, the development nip becomes unstable so that a particular part of the paper is correctly printed while a print state in the other part thereof greatly deteriorates.

SUMMARY OF THE INVENTION

To solve the above and/or other problems, it is an aspect of the present invention to provide a detachable developer in which the developing roller and the photosensitive drum can maintain a uniform development nip even when the development unit and the photosensitive unit are independently installed at a main body, so that image quality improves.

Also, it is an aspect of the present invention to provide a detachable developer in which the development nip between the developing roller and the photoreceptor roller is maintained uniformly so that the image quality improves.

Additional aspects and/or advantages of the invention will be set forth in part in the description which follows and, in part, will be obvious from the description, or may be learned by practice of the invention.

According to an aspect of the present invention, a detachable developer installed in a main body, which includes a first axis connection member extending from an end portion of the photosensitive unit toward a rotation axis of the developing roller and having a first guide slot formed therein in which an end portion of the rotation axis of the developing roller is inserted, and a second axis connection member extending from an end portion of the development unit toward a rotation axis of the photosensitive drum and having a second guide slot formed therein in which the rotation axis of the photosensitive drum is inserted. The first axis connection member and the second axis connection member extend parallel to each other.

The photosensitive unit is installed such that the end portion of the photosensitive unit, from which the first axis connection member extends, directs an inside of a housing, and the development unit is installed such that the other end portion of the development unit, from which the second axis connection member extends, directs an outside of the housing.

The development unit includes a coupling member to transfer a driving force to the development unit, and an axis of the coupling member is capable of moving.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
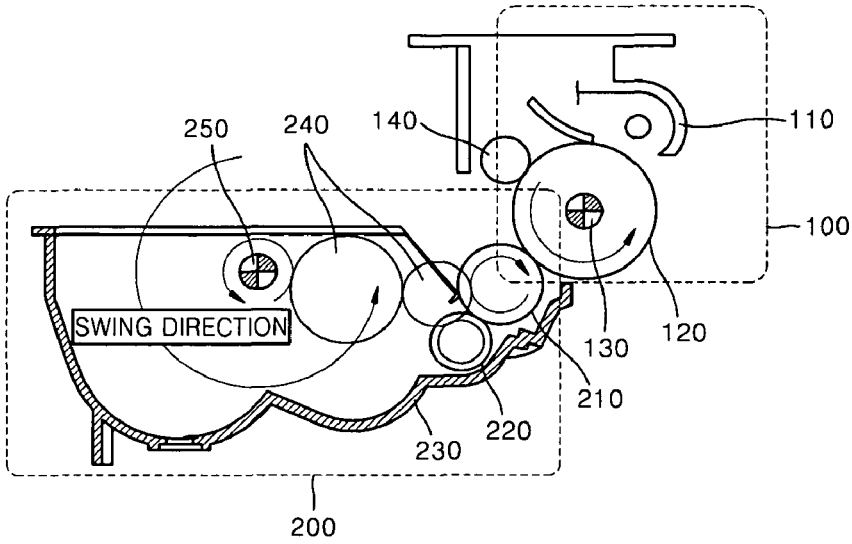
FIG. 1 (PRIOR ART)
FIG. 1 is a sectional view illustrating the structure of a conventional detachable developer.
Figure 2:
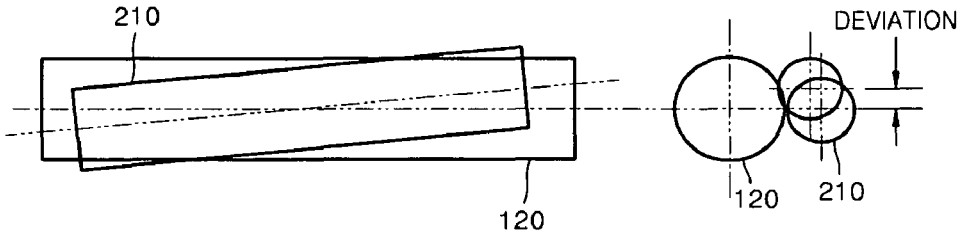
FIG. 2 (PRIOR ART)
FIG. 2 is a view illustrating a state in which the axes of the developing roller and the photosensitive drum in the conventional detachable developer deviate from each other.

Reference will now be made in detail to the embodiment of the present invention, an example of which is illustrated in the accompanying drawings, wherein like reference numerals refer to the like elements throughout. The embodiment is described below to explain the present invention by referring to the figures.

Figure 3:
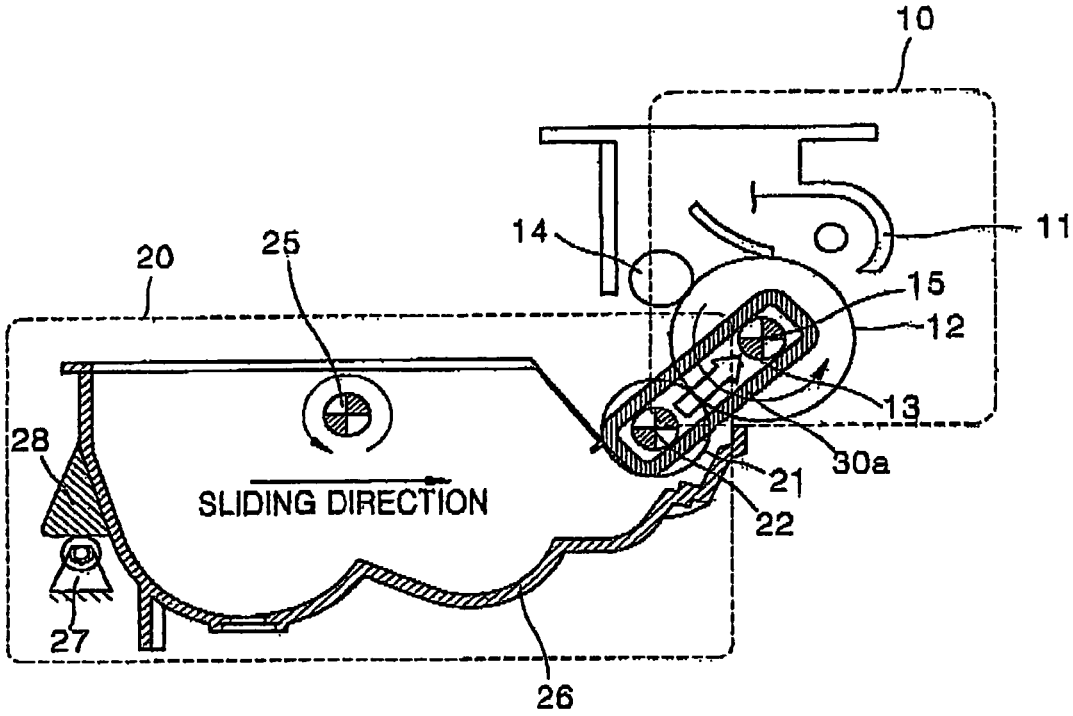
FIG. 3 is a sectional view illustrating the structure of a detachable developer according to an embodiment of the present invention.
Figure 4:
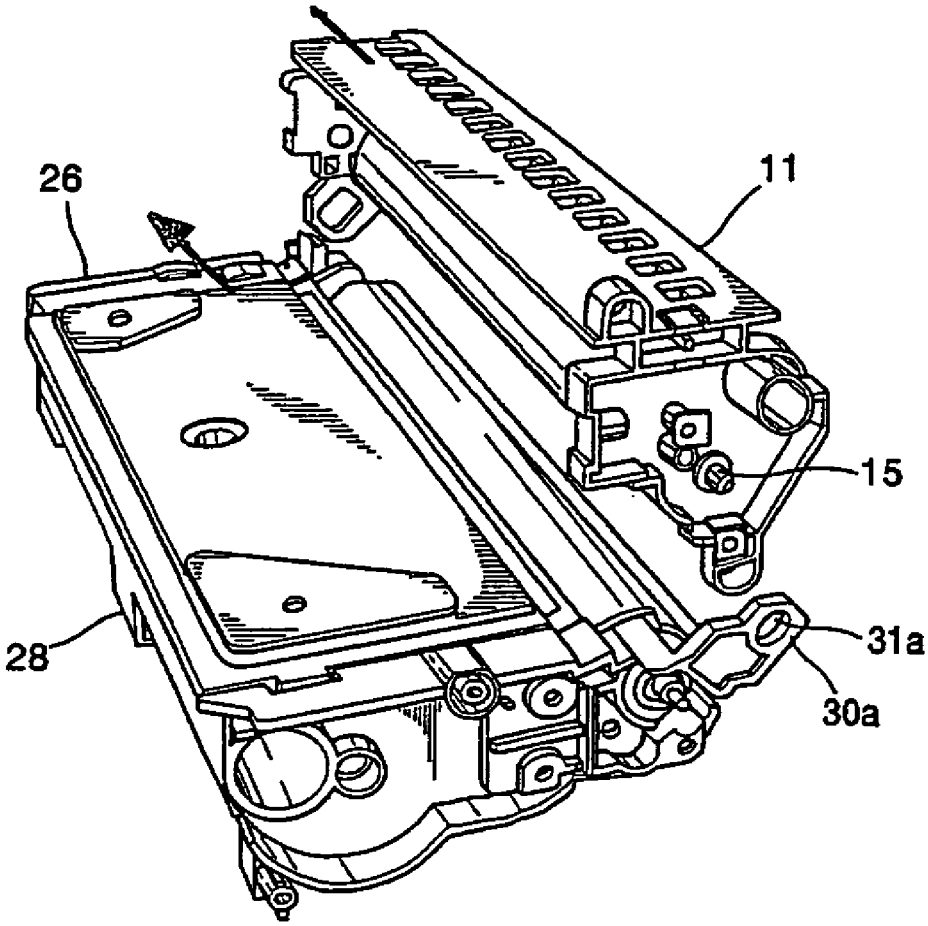
FIG. 4 is a perspective view illustrating a state, viewed on one side, in which the development unit and the photosensitive drum are coupled in the detachable developer according to the embodiment of the present invention.
Figure 5:
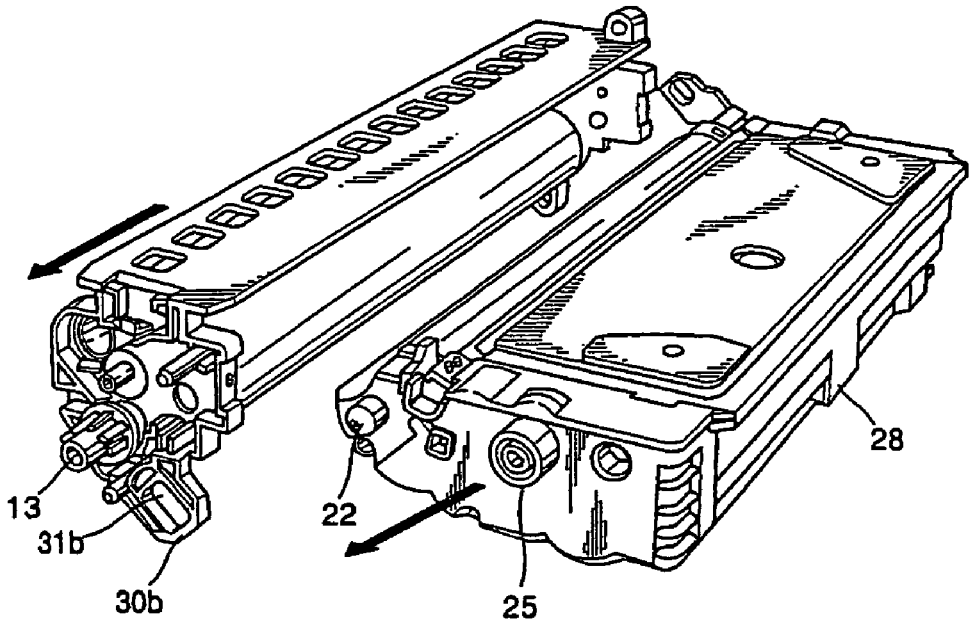
FIG. 5 is a perspective view illustrating a state, viewed on the other side, in which the development unit and the photosensitive drum are coupled in the detachable developer according to the embodiment of the present invention.

Referring to FIG. 3, a developer according to the embodiment of the present invention is a detachable type in which a photosensitive unit 10 and a development unit 20 are separated and independently installed in a printer. A detailed structure of the developer according to the embodiment of the present invention is different, as shown in FIGS. 4 and 5.

The photosensitive unit 10 includes a photosensitive drum 12 and a charge roller 14 which are assembled at their respective positions in a photosensitive unit housing 11. The photosensitive drum 12 is partially exposed from the photosensitive unit housing 11. A photosensitive unit coupling member 13 to transfer driving power from a main body to the photosensitive unit 10 is coupled at one end of a rotation axis of the photosensitive drum 12. The photosensitive unit housing 11 is fixed in a main body frame (not shown) of a printer. The photosensitive unit housing 11 is inserted in the main body along a side direction as indicated by an arrow of FIG. 4. As can be seen from FIG. 5, the photosensitive unit coupling member 13 is disposed in a direction toward the inside of the main body. An axis connection member 30*b* protrudes from a side of the photosensitive unit housing 11, from a side surface where the photosensitive unit coupling member 13 is located, by extending in a direction corresponding to a rotation axis 22 of a developing roller 21. A guide slot 31*b* is formed in the axis connection member 30*b* so that the rotation axis 22 of the developing roller 21 is inserted and slides therein.

The development unit 20 includes the developing roller 21 to provide the photosensitive drum 12 with toner, a toner supply roller (not shown) to supply the toner to the developing roller 21, a development unit coupling member 25 to transfer a driving force from the main body to the development unit 20, a gear train (not shown) having a plurality of gears to transfer the driving force of the development unit coupling member 25 to the developing roller 21 and the toner supply roller, a development unit housing 26 to contain the above parts, and a support protrusion 28 protruding from a rear surface of the housing 26, that is, a surface opposite to a surface where the developing roller 21 is placed. The developing roller 21 is partially exposed from the development unit housing 26 to contact the photosensitive drum 12. The development unit 20 is inserted in the main body along a side direction. When the development unit 20 is installed at the main body, the development unit coupling member 25 is connected to a driving apparatus connection unit (not shown) of the main body.

The development unit coupling member 25 has a flexible axis. For example, the development unit coupling member 25 may be an Oldham coupling. As would be readily understood by one skilled in the art, there are a plurality of flexible axis structures capable of smoothly transferring a driving power, thus, a detailed description thereof will be omitted. Since the axis of the development unit coupling member 25 is flexible, the development unit 20 does not rotate around the development unit coupling member 25 and moves linearly back and forth with the coupling member 25 by a force of a spring (not shown) provided at the main body. When the development unit 20 moves back and forth, a support roller 27 installed at the main body rotates and supports the support protrusion 28 so that the rear surface of the development unit 20 can be supported.

An axis connection member 30*a* protrudes from a side of the development unit housing 26, corresponding to aside opposite to the axis connection member 30*b* formed on the photosensitive unit housing 11, by extending in a direction corresponding to a rotation axis 15 of the photosensitive drum 12. A guide slot 31*a* is formed in the axis connection member 30*a* so that the rotation axis 22 of the photosensitive drum 12 is inserted and slides therein. The two axis connection members 30*a* and 30*b* are formed parallel to each other.

Figure 6:
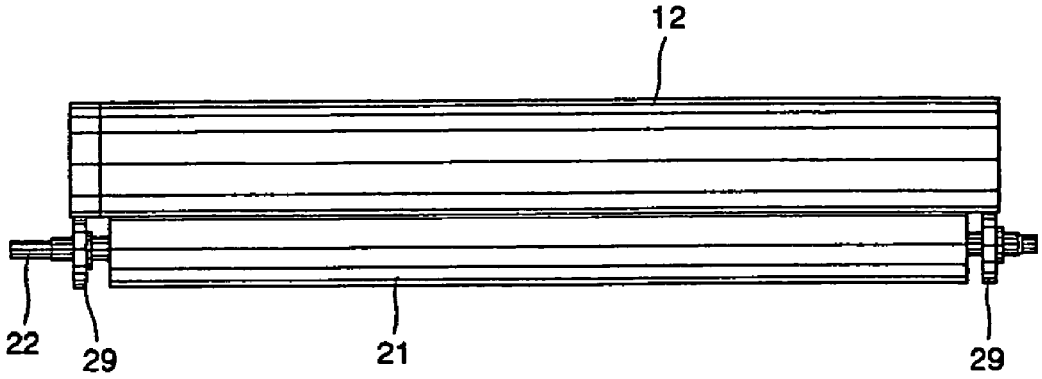
FIG. 6 is a view illustrating a state in which the developing roller and the photosensitive drum are in contact with each other in the detachable developer according to the embodiment of the present invention.

As shown in FIG. 6, a circular disc 29 having a predetermined diameter is coaxially formed at both ends of the rotation axis 22 of the developing roller 21. When the developing roller 21 contacts the photosensitive drum 12, the disc 29 contacts the photosensitive drum 12 at the left and right ends of the photosensitive drum 12 to thereby prevent an excessive nip. Thus, the disc 29 may have a size corresponding to the development nip depth.

In the operation of the detachable developer having the above structure, the photosensitive unit 10 is inserted in the main body frame along its axis direction through the side portion of the main body. Here, the photosensitive unit coupling member 13 directs the inside of the main body. When the photosensitive unit 10 is completely installed, the photosensitive unit coupling member 13 is connected to the driving apparatus of the main body. Then, the development unit 20 is inserted in the main body frame along its axis direction through the side portion of the main body.

When both the photosensitive unit 10 and the development unit 20 are completely installed in the main body, as shown in FIGS. 5 and 6, the rotation axes 15 and 22 respectively of the photosensitive drum 12 and the development roller 21 are inserted in the guide slots 31*a* and 31*b* of the axis connection members 30*a* and 30*b*, respectively. That is, the rotation axis 22 of the developing roller 21 of the development unit 20 is inserted in the guide slot 31*b* of the axis connection member 30*b* extending from the side surface of the photosensitive unit housing 11 while the rotation axis 15 of the photosensitive drum 12 is inserted in the guide slot 31*a* of the axis connection member 30*a* extending from the side surface of the development unit housing 26. The axis connection members are formed at only one side surface of each of the photosensitive unit 10 and the development unit 20. Thus, the rotation axes 15 and 22 are easily insertable by installing the photosensitive unit 10 and the development unit 20. The axis connection member 30*b* formed on the photosensitive unit housing 11 and the axis connection member 30*a* formed on the development unit housing 26 are formed at opposite directions. Each of the guide slots 31*a* and 31*b* of the axis connection members 30*a* and 30*b* has a predetermined length so that the rotation axes 15 and 22 can slide therein, and has a predetermined width so as not to prevent the sliding of the rotation axes 15 and 22.

Since the photosensitive unit 10 is first inserted from the main body and then the development unit 20 is inserted, the axis connection member 30*b* of the photosensitive unit 10 is formed on a surface facing the inside of the main body while the axis connection member 30*a* of the development unit 20 is formed on a surface opposite to the surface facing the inside of the main body. If the directions of the axis connection members 30*a* and 30*b* are reversed, the insertion of the development unit 20 is prevented. When the development unit 20, not the photosensitive unit 10, is first inserted in the main body, the positions where the axis connection members 30*a* and 30*b* are formed are to be reversed.

When the development unit 20 is completely installed in the main body, the support protrusion 28 protruding from the rear surface of the development unit 20, that is, the surface opposite to the surface having the developing roller, is accommodated on the support roller 27 installed on the main body. Thus, a front portion of the development unit 20 is supported by the two axis connection members 30*a* and 30*b* and a rear portion thereof is supported by the support roller 27. Since the development unit 20 is supported at three positions, it can be maintained in a stable state. In this state, as shown in FIG. 3, the entire development unit 20 moves in a direction toward the photosensitive unit 10 by a force of the spring. Accordingly, since the rotation axis of the coupling member 25 of the development unit 20 can be moved, the development unit 20 moves back and forth.

When the development unit 20 moves toward the photosensitive unit 10, the two axis connection members 30*a* and 30*b* and the two rotation axes 15 and 22 inserted in the guide slots 31*a* and 31*b* of the axis connection members 30*a* and 30*b* perform relative motions. The rotation axis 15 of the photosensitive drum 12 and the rotation axis 22 of the developing roller 21 are parallel to each other and the photosensitive drum 12 and the developing roller 21 contact each other at a position suitable for forming an image. Here, as the discs formed at both ends of the rotation axis 22 of the developing roller 21 contact both ends of the photosensitive drum 12, the photosensitive drum 12 and the developing roller 21 are prevented from contacting each other too closely. Usually, it is difficult to accurately adjust the force of the spring to make the photosensitive drum 12 and the developing roller 21 contact each other with an appropriate force and the nip between the photosensitive drum 12 and the developing roller 21 is not uniform with the force of the spring only. Thus, the nip is restricted not to be excessive using the disc 29 instead of pressing the development unit 20 with a sufficient force of the spring. The photosensitive drum and the developing roller of the detachable developer can maintain a uniform development nip through the above operation.

As described above, the detachable developer according to the embodiment of the present invention has the following advantages.

First, in the detachable structure in which the photosensitive unit and the development unit are separately and independently installed in the main body, since the axis connection members are formed on the photosensitive unit and the development unit to maintain a uniform development nip between the developing roller and the photosensitive drum, the quality of the image is improved.

Second, since one of the axis connection members is formed at an end side surface of the photosensitive unit and the other axis connection member is formed at the opposite side surface of the development unit, an interference during installation is avoidable so that the photosensitive unit and the development unit can be easily installed.

Third, when the development unit moves toward the photosensitive unit, since the development unit is supported at the three positions by the two axis connection members and the support roller, even when the photosensitive unit and the development unit are twisted, the rotation axis can secure a stable position in the guide slot of the axis connection member. Thus, a stable development nip can be maintained when a torque occurs due to manufacturing errors.

Finally, since the development nip can be adjusted by installing a circular disc having a size corresponding to the development nip depth on the same axis of the development roller, forming a uniform image is guaranteed.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body;

a photosensitive member;

a developing device detachably mountable to the main body, and configured and positioned to engage the photosensitive member, the developing device including a roller;

a first support portion positioned at a first surface of the developing device, the first support portion being a roller and the first surface being a lower surface, the roller of the developing device being between the first surface and the photosensitive member;

a second support portion positioned at a second surface of the developing device in a first direction of an axis of the roller; and a third support portion positioned at a third surface of the developing device in a second direction of the axis of the roller, wherein the first, second and third support portions are configured and positioned to support the developing device to move back and forth in a direction that the developing device is urged toward the photosensitive member.

2. An image forming unit comprising:

a main body;

a photosensitive unit having a photosensitive unit housing detachably installed at the main body and a rotatable photosensitive drum;

the developing unit having a development unit housing detachably installed at the main body and a developing roller rotatably provided and facing the photosensitive drum;

a biasing member mounted in the main body to bias the developing unit toward the photosensitive unit; and a first support member in cooperation with the biasing member to support a lower outer portion of a first surface of the development unit housing when the development unit housing engages the photosensitive unit, the first surface being arranged opposite to the photosensitive unit.

3. The image forming unit as claimed in claim 2, further comprising:

a second support member positioned at a second surface of the development unit housing and extending in a first direction relative to an axis of the developing roller to support an axis of the photosensitive drum.

4. The image forming unit as claimed in claim 3, further comprising:

a third support member positioned at a surface of the photosensitive unit housing and extending in a second direction relative to an axis of the developing roller to support the axis of the developing roller.

5. The development unit as claimed in claim 2, wherein the first support member is in cooperation with the biasing member mounted in the main body and configured to support the development unit housing when the development unit housing moves back and forth relative to the photosensitive unite to maintain a uniform development nip.

* * * * *

UNITED STATES PATENT AND TRADEMARK OFFICE

CERTIFICATE OF CORRECTION

PATENT NO. : 7,783,229 B2
APPLICATION NO. : 12/007692
DATED : August 24, 2010
INVENTOR(S) : Joo-hwan Noh It is certified that error appears in the above-identified patent and that said Letters Patent is hereby corrected as shown below:

Column 8, Line 26 in Claim 5, delete “unite” and insert -- unit --, therefor.

Signed and Sealed this
Eleventh Day of January, 2011

David J. Kappos

David J. Kappos
*Director of the United States Patent and Trademark Office*